United States Patent [19]

Müller et al.

[11] Patent Number: 4,832,581

[45] Date of Patent: May 23, 1989

[54] DIAPHRAGM PUMP WITH CIRCULATION FLUSHING

[75] Inventors: Adolf Müller, Möglingen; Eberhard Schlücker, Erlangen, both of Fed. Rep. of Germany

[73] Assignee: LEWA Herbert Ott GmbH & Co., Fed. Rep. of Germany

[21] Appl. No.: 812,348

[22] Filed: Dec. 23, 1985

[30] Foreign Application Priority Data

Dec. 21, 1984 [DE] Fed. Rep. of Germany ..... 3446952

[51] Int. Cl.[4] ..... F04B 43/06

[52] U.S. Cl. ..... 417/383

[58] Field of Search ..... 417/383–388

[56] References Cited

U.S. PATENT DOCUMENTS

| | | | |
|---|---|---|---|
| Re. 29,055 | 11/1976 | Wagner | 417/388 |
| 2,578,746 | 12/1951 | Scherger | 417/383 |
| 3,767,326 | 10/1973 | Hetz | 417/383 |
| 4,403,924 | 9/1983 | Gebauer et al. | 417/388 |
| 4,465,438 | 8/1984 | Brauer | 417/386 |

FOREIGN PATENT DOCUMENTS

| | | | |
|---|---|---|---|
| 2216215 | 10/1973 | Fed. Rep. of Germany | 417/388 |

*Primary Examiner*—Leonard E. Smith

*Attorney, Agent, or Firm*—Bierman & Muserlian

[57] ABSTRACT

In a diaphgram pump with a diaphragm that separates a delivery chamber from a work-chamber filled entirely with fluid medium, and with a piston chamber which is connected to the diaphragm work-chamber by way of at least two passages and in which a displacement piston is reciprocatingly movable to effect the oscillatory actuation of the diaphragm, with the passages for flushing out gas bubbles shaped in such a manner that the mean velocity of flow in each single passage is always aimed in one stroke direction. The arrangement and shape of the passages connecting the work-chamber with the piston chamber is provided here in such a manner that the total resistance to flow of all the passages, made up of the parallel resistances of the individual passages, is different in one direction of flow than that in the other direction of flow, and that thereby there results in all passages a total transport flow for any gas bubbles contained in the fluid medium.

9 Claims, 2 Drawing Sheets

DIAPHRAGM PUMP WITH CIRCULATION FLUSHING

Figure 1:
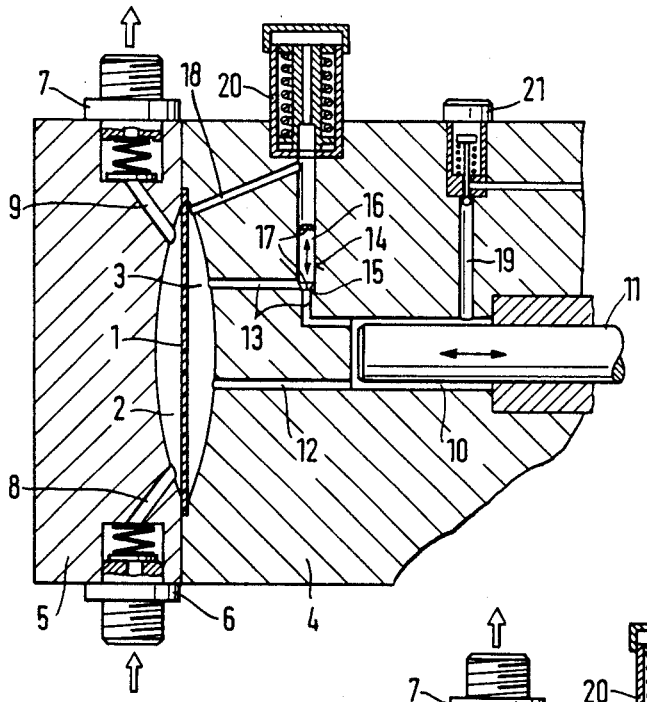

The invention is concerned with a diaphragm pump with a diaphragm that separates a delivery chamber from a work-chamber filled entirely with fluid medium, and with a piston chamber which is connected to the diaphragm work-chamber by way of at least two passages and in which a displacement piston is reciprocatingly movable to effect the oscillating actuation of the diaphragm, with the passages for flushing out gas bubbles shaped in such a manner that the mean velocity of flow in each single passage is always in one stroke direction.

In the known diaphragm pump of the generic type it cannot be avoided that gas previously dissolved in the fluid medium is released from it and then collects in the form of gas bubbles at undesired locations, interfering with the efficient operation of diaphragm, such locations being, for example, the connecting passages between piston chamber and diaphragm work-chamber.

Degassing of these chambers causes great difficulties in smaller diaphragm pumps, and also when the connecting passages are conventionally designed, and under certain circumstances this is altogether impossible. Therefore, degassing represents in many instances a problem that has remained unsolved thus far, or, because it is connected with great constructional effort, it has been solved only in an unsatisfactory way.

In diaphragm pumps of a certain size and in which a certain high flow rate obtains in the connecting passages between piston chamber and diaphragm work-chamber, it can indeed be almost impossible for gas bubbles to settle in the connecting passages. In addition, even if gas bubbles were to settle, there would nonetheless be no impairment of the metering accuracy.

Such an effect of gas bubbles always forming in the fluid medium proves the more detrimental, however, the smaller the stroke volume, and thereby the smaller the delivery flow of the diaphragm pump. This is based on that the velocities of flow then obtaining in the connecting passages will also be lower, and the ratio of the pump's stroke volume to the volume of gas bubbles formed will become more unfavorable. This is due to that a certain stroke portion of the displacement piston is lost, in order to condense the gas bubbles from suction pressure to delivery pressure. However, this stroke portion does not produce any delivery, which is unacceptable especially for small diaphragm pumps and particularly for micrometering pumps.

The aforementioned lost or ineffective stroke portion of the displacement piston, which does not produce any delivery, would not necessarily have to be regarded as disadvantageous, if the gas bubbles forming in the fluid medium were to have an equal volume at all times. This is not the case, however, since gas bubbles are formed in an irregular pattern and disappear again, so that as a result the total metering flow fluctuates with the number of gas bubbles formed. The aforementioned disadvantageous actions thus cause a considerable deterioration of the metering accuracy of a diaphragm pump, which proves to be the more disadvantageous, the smaller the stroke volume of the pump, since the ratio of stroke volume to gas bubble volume becomes ever more unfavorable here.

A diaphragm pump is already known, however, in which for flushing out gas bubbles, each of the two passages connecting the diaphragm work-chamber to the piston chamber is provided with a check valve, namely in such a manner that the two check valves open and shut, respectively, in the opposite direction. This arrangement acts like a pump with a suction and a pressure valve, since the passage provided with the suction valve operates only during the suction stroke of the piston, while the other passage, provided with the pressure valve, acts only during the piston's discharge stroke. In this manner, pure circulation flow of the fluid medium is obtained inside the two connecting passages, whereby the gas bubbles that have formed in the fluid medium are forcibly flushed out.

This known arrangement has proved disadvantageous, however, because a check valve must be provided for the effective functioning in all the available connecting passages between the diaphragm work-chamber and the piston chamber. This is not only a structurally costly measure that increases the price of the respective diaphragm pump, but in some cases also proves impractical, especially in those cases, where either relatively many connecting passages are provided, or when these connecting passages have a very small sectional area, so that arrangement of a check valve would not even be feasible.

The invention therefore has as its object to provide circulation flushing in the diaphragm pump of the generic type, which is to be realized with an extraordinarily small structural effort and is independent of the number of connecting passages provided, so that particularly in small diaphragm pumps the settling of gas bubbles is prevented, and it is achieved at the same time that the gas bubbles are automatically transported to a location whence they are removed from the piston chamber or from the diaphragm work-chamber.

This problem is solved by the characteristics set forth in claim 1. Advantageous embodiments of the invention are indicated in the additional claims.

Overall, the invention is based on the essential idea that the common total resistance to flow of all passages, made up of the parallel resistances of the individual passages, be allowed to be different in one direction of flow from that in the other direction of flow. It has therefore been found according to the invention that there is no need for a structurally expensive design, such as that of the state of the art, where every single passage is provided with a check valve which opens inversely to that of the other passage, in order to achieve thereby a pure circulation flow in the sense of a classical circulation, but rather that it is sufficient if only the mean direction of flow moves in a single definite direction. While according to the state of the art the total resistance to flow of all passages is the same in both directions of flow, according to the invention it is different in one direction of flow from that in the other direction of flow, as set forth, so that— and this is of essential importance — overall one flow of the fluid medium will result. Thus, the invention permits a flow in the passages, which can also be opposite to the mean direction of flow, provided it is ensured that the respective total resistance to flow of all passages is different during intake stroke than during the discharge stroke. This idea of the invention can be expressed by formula in the following way:

Proceeding on the assumption that the common total resistance to flow R of all passages k is constituted by the parallel resistances of the individual passages $k=1, 2, 3 \ldots n$, and is accordingly calculated from:

$$\frac{1}{R} = \frac{k=n}{k=1} \frac{1}{R_k},$$

then the total resistance to flow $R_S$ in suction stroke when:

$$\frac{1}{R_S} = \sum_{k=1}^{k=n} \frac{1}{R_{Sk}} = \frac{1}{R_{S1}} + \frac{1}{R_{S2}} + \ldots$$

and the total resistance to flow $R_D$ in discharge stroke when:

$$\frac{1}{R} = \sum_{k=1}^{k=n} \frac{1}{R} = \frac{1}{R} + \frac{1}{R} + \ldots,$$

where, according to the invention:

$$\frac{1}{R_S} \neq \frac{1}{R_D}$$

According to a preferred embodiment, the following applies:

$$\frac{1}{R_S} < \frac{1}{R_D}$$

In the realization of this inventive idea, only one of the connecting passages between piston chamber and diaphragm workchamber has been shaped differently in the diaphragm pump according to the invention, in order to make the mean velocity of flow other than zero. In this respect, mean velocity of flow is understood to be the difference between velocity of flow during intake stroke and that during discharge stroke. In other words, this means that no purely neutral pulsating flow of the fluid medium obtains, and that there is also no pure circulation flow, as is the case in the known diaphragm pump, but rather such a flow obtains in each passage that the mean velocity o flow is aimed in one direction, i.e., in the intake stroke direction or in the discharge stroke direction, with the gas bubbles being discharged.

According to the invention, this can be achieved by a corresponding construction of only one passage, and not of all the passages, namely in such a manner that resistance to flow in one direction of flow (intake or discharge stroke) is considerably greater than in the other (intake or discharge) direction of flow. Based on this construction, a very much smaller velocity of flow will set in in the special modified passage, when the piston moves in one direction than when the piston moves in the other direction. This has a corresponding effect on the other passages, which means, for example, that when a in the modified passage a considerably reduced velocity of flow obtains during the intake stroke, or almost no fluid medium flows, and during the discharge stroke a certain higher velocity of flow obtains, then of necessity exactly the opposite will result in the other passages, since compensation must be achieved, and due to the reciprocating displacement piston the same quantity of fluid medium is always transported during the intake stroke and during the discharge stroke.

Accordingly, when in the modified passage, during the intake stroke, for example, the velocity of flow is greatly reduced or is close to zero, then this velocity of flow of the fluid medium must be higher in the other passages during the intake stroke, whereas in the example described, the same velocity of flow prevails or can prevail in all passages during the discharge stroke. Overall, this produces the desired technical effect that in all those passages, in which the construction according to the invention is provided, a higher resistance to flow prevails during the intake stroke, for example, so that in total, a mean velocity of flow in the discharge stroke direction will result, i.e., in the direction towards the diaphragm., while correspondingly, in the other passages a velocity of flow in the intake stroke direction results, i.e., in the direction of the displacement piston.

For this reason, gas bubbles which may settle in the connecting passages, are practically transported in a certain desired direction, whereby in all those passages, in which no alteration of the resistance to flow was made, a movement of the gas bubbles in the direction of the intake stroke takes place, i.e., in the direction of the displacement piston, while in the specially designed passage, which exhibits an increased resistance to flow in one direction of flow, a transport of the gas bubbles in the direction of the discharge stroke takes place, i.e., in direction towards the diaphragm.

This brings about the desired flushing effect in the desired direction, i.e., in the direction of the piston and/or in the direction of the diaphragm.

Accordingly, the diaphragm pump of the invention is distinguished by having only a single passage in such a modified form that the resistance to flow prevailing in it for the fluid medium moved by the displacement piston during the discharge stroke and during the intake stroke will in one direction of flow differ from that in the other direction of flow, so that overall in all passages a transport flow is formed for gas bubbles contained in the fluid medium.

A special constructional development of the invention is to be seen in that the modified-shape passage exhibits a damper that under the action of the flow of the fluid medium is movable between two positions, and which in one position has no effect on the velocity of flow of the fluid medium, yet in the other position creates an increased resistance to flow and thereby reduces the velocity of flow of the fluid medium.

Particular advantages are obtained, when this damper is formed by a pin which is arranged in the approximately perpendicular bore section of the modified-shape passage, and which in its position exerting increased resistance to flow rests on a shoulder of the bore section by virtue of the force of gravity.

This means that the pin serving as damper must be shaped, according to the invention, in such a manner that the resistance to flow of the passage provided with this pin must be very high during the intake stroke. Such a pin need not necessarily rest tightly on the shoulder of the bore section, but must only during the intake stroke produce a resistance to flow in the respective passage, which is very high in comparison to that obtaining during the discharge stroke.

The only structural effort can be seen in that an additional pin must be provided to serve as damper and which, in an easily produced separate bore section of the respective passage, can be raised during the discharge stroke under the effect of the flowing fluid medium, on the one hand, and which can be lowered, i.e , attached to the shoulder of the bore section, during the intake stroke by virtue of the force of gravity, on the other hand.

The pin serving as damper is expediently provided with chamfered edges at least at its lower end, so that it will thereby be possible, by means of an appropriate design of the pin, to influence the extent of the increase of the resistance to flow during the intake stroke.

It is within the framework of the invention to provide the piston chamber and/or work-chamber with a separate ventilating duct which ends in a conventional air-exhaust or relief valve and facilitates the removal of the gas bubbles eliminated from the passages by means of the invention.

The invention produces the substantial advantage that it can be employed with pumps of all sizes, since only a small constructional and cost-related effort is required to achieve the flushing or circulation flushing, respectively, provided pursuant to the invention. The special type of flushing is feasible with all pump sizes also because only a part of the fluid medium must flow by the damper. For the rest, application of the invention does not depend on the number of connecting passages provided, which results in a further, considerable advantage.

Accordingly— and as distinct from the state of the art—two fundamental requirements are satisfied by the invention, namely that on the one hand, the flow and/or connecting passages can be as small as possible in cross-section, in order to avoid damage to the diaphragm in its rear emplacement. On the other hand, the loss of pressure in the connecting passages should also be as small as possible. This means that for the connection between the piston chamber and the diaphragm work-chamber several, to wit, at least two flow passages must be provided, while it should be advantageous to provide five or six flow passages, for example. To achieve the desired releasing flush—effect, it is important—in the sense of the invention—that the mean velocity of flow, i.e., the chronological mean value of the velocity of flow, be other than zero and that thereby no purely pulsating flow will take place. This is of importance, according to the invention, because experience has shown that gas bubbles present in the respective connecting passage during a purely pulsating flow can never be expelled from this passage.

Accordingly, it is of particular importance that the mean velocity of flow, which according to the invention is other than zero, is always aimed in the direction of the degassing chamber.

In further development of the invention it is furthermore also possible to provide in the modified-shape connecting passage a valve in place of the pin acting as damper.

In yet further development of the invention, this valve is arranged in the modified-shape passage in such a manner that it will open during the intake stroke and close during the discharge stroke.

Expediently, the other passage is shaped in such a manner that it exhibits a high resistance to flow.

In this respect, it is within the invention's framework that the passage exhibiting a high resistance to flow is in the shape of a thin bore.

It is advantageous to effect the arrangement and shape of the passages in such a manner that their total resistance to flow is smaller during the intake stroke than during the discharge stroke. This means, for example, that in the last mentioned exemplified embodiment, the cross-sectionally larger passage should be open during the intake stroke, while the passage exhibiting the throttle-section is then active during the discharge stroke.

A particularly expedient development is on hand when the passage exhibiting the high resistance to flow, i.e., the throttle-section, for example, is arranged higher than the passage exhibiting the valve that is open during intake stroke, since in this passage provided with the throttle-section a gas bubble transport is constantly present, i.e., both during intake stroke and also during the discharge stroke, and therefore this passage should be at that upper most position, towards which the gas bubbles are always drawn to by virtue of their buoyancy in the fluid medium.

Figure 2:
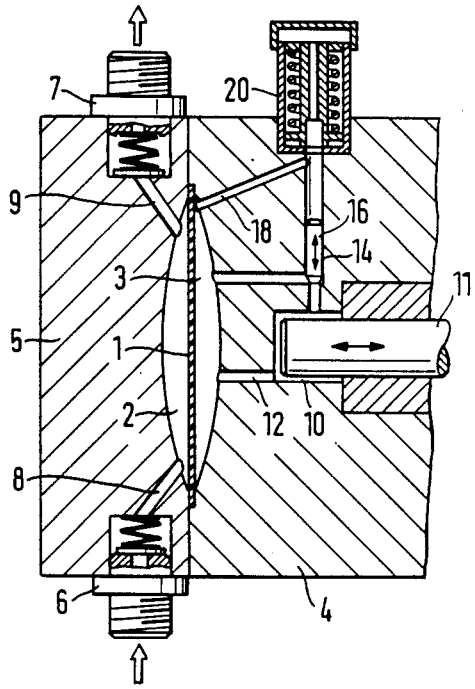
Figure 3:
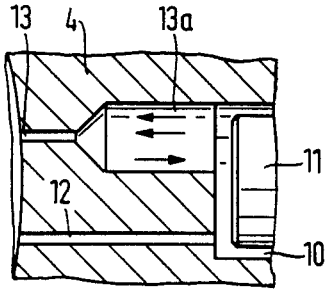
Figure 4:
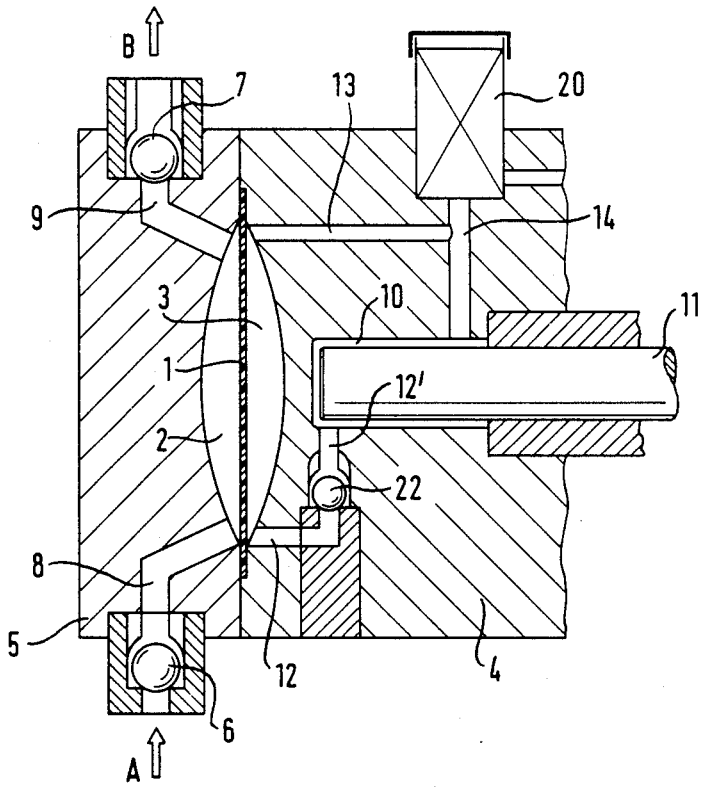

The invention is hereinfollowing described in greater detail in the form of several exemplified embodiments with the aid of the drawing. The latter shows in:

FIG. 1 a diaphragm pump according to the invention, in vertical section;

FIG. 2 a modified embodiment of the passages connecting the piston chamber with the diaphragm work-chamber, FIG. 3 an additional modified embodiment of a development of one of the connecting passages, and FIG. 4 an additional modified specific embodiment.

As can be gathered from the drawing, in the diaphragm pump illustrated, a diaphragm 1 is provided, which separates a delivery chamber 2 containing the flow medium from a diaphragm work-chamber 3.

The diaphragm work-chamber 3 is arranged in the front end of a pump casing 4 which for its part is closed by a casing cover 5 which contains the delivery chamber 2. In addition, an intake valve 6 and a discharge valve 7 are arranged in housing cover 5, which are connected to the delivery chamber 2 by way of passages 8 and 9, respectively, so that when the diaphragm 1 is oscillatorily actuated, the flow medium is transported in the direction of the arrows shown in connection with the valves 6, 7.

In the pump casing 4, a piston chamber 10 is additionally provided in the manner illustrated, in which chamber a displacement piston 11 is reciprocating to effect the oscillating actuation of diaphragm 1. The piston chamber 10 is connected to the diaphragm work-chamber 3 by way of two, essentially horizontal connecting passages 12, 13. The entire assembly composed of diaphragm work-chamber 3, connecting passages 12, 13 and piston chamber 10, which admits the displacement piston 11, represents a pressure chamber that is entirely filled with fluid medium. A perpendicular bore section 14 is formed within the upper connecting passage 13, which at its lower end has a shoulder 15 an reciprocatingly admits a pin 16 serving as damper. This pin 16 is provided with chamfered edges 17 at both its ends and is subject substantially only to the action of the force of gravity, so that during the intake stroke, i.e., during the motion of displacement piston 11 towards the right in FIG. 1, it rests on the shoulder 15 of the perpendicular bore section 14 under the action of this force of gravity. As a result, due to the reduced flow section prevailing in the upper connecting passage 13, the resistance to flow is considerably increased during the intake stroke of displacement piston 11, so that accordingly, also in comparison with the discharge stroke, a smaller quantity of fluid medium can reach the piston chamber 10 from the work-chamber 3 by way of the upper connecting passage 13. In compensation, a correspondingly greater quantity of fluid medium must be transported in the lower connecting passage 12 from the workchamber 3 to the piston chamber 10, which naturally increases the velocity of flow and provides for the mean velocity of flow in the lower passage 12 to be directed towards the piston chamber 10, while in the upper passage 13, the mean velocity of flow points in the direction of diaphragm 1.

Based on the action of pin 16, which is substantially subject only to the force of gravity, it is raised from the lower shoulder 15 in the perpendicular boring section 14 by the fluid medium being transported to the left in FIG. 1, when the displacement piston 11 carries through the discharge stroke in the direction of diaphragm 1, and said pin is raised so far that during the discharge stroke the resistance to flow in passage 13 will correspond approximately to that in passage 12.

However, since in total the resistance to flow in passage 13 in the direction of the intake stroke is considerably higher than in the direction of the discharge stroke, there results, as already set forth, a mean velocity of flow in passage 13 —and with it a migration of any gas bubbles—in the direction of diaphragm 1 while this mean velocity of flow in the lower passage 12 points in the direction of the piston chamber 10 and the discharge stroke, respectively, for the purpose of the necessary compensation, and thereby transports also any gas bubbles present in this passage 12 in the direction of piston chamber 10. In this manner, a total migration of the gas bubbles takes place, so that a settling of these gas bubbles in passages 12, 13 is effectively prevented and at the same time their transport out of passages 12, 13 is ensured.

In order to evacuate completely from the diaphragm pump the gas bubbles transported out of passages 12, 13, it has ventilating ducts 18, 19 arranged in the conventional manner, which begin at the highest position of diaphragm chamber 3 or piston chamber 10, respectively, and open into the open air or into a suitable container by way of a gas-expelling valve 20 or a relief valve 21.

The modified embodiment according to FIG. 2 differs from the one according to FIG. 1 in that the horizontal section of the upper passage 13, which in the embodiment pursuant to FIG. 1 runs between piston chamber 10 and the vertical bore section 14, is omitted in tee embodiment according to FIG. 2, so that this vertical bore section 14 ends directly in piston chamber 10.

In the embodiment according to FIG. 3, one of the two connecting passages 12 and 13, namely the upper passage 13, is provided with an enlargement 13*a* which adjoins piston chamber 10. This has the effect that during the discharge stroke of piston 11 a greater flow results in passage 13, shown by double arrows, and a reduced flow results in passage 12, show by a single arrow, so that the desired flushing effect is completely achieved and in this embodiment, too, the gas bubbles are expelled.

In the further modified embodiment according to FIG. 4, the lower passage 12 is provided with a vertical passage section 12' which directly adjoins the piston workchamber 10 and has a valve 22. This valve 22 is arranged in such a manner that, as shown in FIG. 4, it opens during the intake stroke of displacement piston 11 and closes during the discharge stroke.

Furthermore, regarding the higher situated passage 13, the construction shown in the illustrated exemplified embodiment is such that this passage 13 has a high resistance to flow. To this end it is shaped as a thin bore, i.e., in such a way that its opening is clearly smaller than that of the geodetically lower passage 12. The passage 13 does not adjoin with its end the piston chamber 10 directly, but is connected to it by way of the vertical bore section 14 which connects the piston chamber 10 with the gas expelling valve 20.

If in a practical exemplified embodiment the lower passage 12, because of its cross-section, has a resistance to flow R, for example, which during the intake stroke is $R_S=0.1$ and during the discharge stroke is $R_D=\infty$, then the upper passage 13, which is provided with the aforementioned throttle section to achieve a high resistance to flow, should have a resistance to flow R lying between the two aforementioned resistance values of passage 12, namely R =1, for example, in order to thereby render the transport action for the gas bubbles to be expelled as strong as possible. The aforesaid resistance value of R =1 can of course easily be achieved through a corresponding dimensioning of the cross-section of upper passage 13.

As can easily be seen in FIG. 4, the arrangement and shape of passages 12, 13 are such that their total resistance to flow is small during the intake stroke, since the valve 22 situated in the lower passage 12 opens during the intake stroke, thus making available the total cross-section, made up of the individual cross-sections of passages 12, 13, for the return transport of the fluid medium during the intake stroke. This brings about a transport of the gas bubbles in such a manner that these move both in the lower passage 12 and in the upper passage 13 from the diaphragm work-chamber 3 in the direction of piston chamber 10.

In contrast to that, the total resistance to flow of passages 12, 13 is great during the discharge stroke of the displacement piston 11, since in such a case no transport of fluid medium through the lower passage 12 takes place due to the then closed valve 22, and the entire transport of the fluid medium from piston chamber 10 to diaphragm work-room 3 takes place through passage 13. Accordingly, any gas bubbles formed in the fluid medium during the discharge stroke move within passage 13 in the direction of diaphragm work-chamber 3, namely with a velocity of flow that is greater than that of the ga bubbles during the intake stroke of displacement piston 11. Thus there results a total transport flow which finally transports the gas bubbles through the vertical bore section 14 to the gas-expelling valve 20. Altogether, the desired flushing effect is thereby achieved.

For proper reasons, it is expressly stated that individual characteristics of the described exemplified embodiments can, if desired, be exchanged among each other at will or combined with each other, respectively.

We claim:

1. A diaphragm pump with a diaphragm separating a delivery chamber from a working chamber completely filled with an hydraulic medium, a piston chamber in which a displacement piston is movable back and forth for the oscillating activation of the diaphragm, at least two channels connecting the diaphragm working chamber with the piston chamber, and which for the purposes of flushing out gas bubbles is formed so that the mean flow rate in each individual channel is always directed into one stroke direction and at least one ventilation channel for the piston chamber and the diaphragm working chamber respectively means, in the channels (12,13) are arranged so that the total flow resistance of all channels (12,13) during the intake stroke is smaller than during the compression stroke, with only one single channel (12 respectively 13) being modified so that its flow resistance in the one direction of flow is different from that in the other direction of flow.

2. A diaphragm pump of claim 1 wherein the modified channel (13) had a resistance body (16) displaceable between two positions by the flow of the hydraulic medium, which in the one position does not exert any influence on the flow rate of the hydraulic medium, but in the other position, generates an increased flow resistance to decrease the flow rate of the hydraulic medium.

3. A diaphragm pump of claim 2 wherein the resistance body is formed by a pin (16) arranged in a bore section (14) extending approximately vertically in the modified channel (13).

4. A diaphragm pump of claim 3 wherein the pin (16) in its position exerting the increased flow resistance rests by the effect of gravity on one shoulder (15) of the bore section (14).

5. A diaphragm pump of claim 3 wherein the pin (16) at its lower end is provided with beveled edges (17).

6. A diaphragm pump of claim 1 wherein the modified channel (13) has a cross-sectional widening (13*a*).

7. A diaphragm pump of claim 1 wherein the modified channel (12) has a valve (22) arranged to open during the intake stroke and close during the compression stroke.

8. A diaphragm pump of claim 7 wherein the other channel (13) is designed to have a high flow resistance.

9. A diaphragm pump of claim 8 wherein the channel (13) having the high flow resistance is formed as a thin bore.

* * * * *